US008111130B2

(12) United States Patent
Tsukada

(10) Patent No.: US 8,111,130 B2
(45) Date of Patent: Feb. 7, 2012

(54) CHIP RESISTOR AND METHOD FOR MANUFACTURING THE SAME

(75) Inventor: Torayuki Tsukada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 293 days.

(21) Appl. No.: 12/465,226

(22) Filed: May 13, 2009

(65) Prior Publication Data

US 2009/0284342 A1 Nov. 19, 2009

(30) Foreign Application Priority Data

May 14, 2008 (JP) ..... 2008-126942
Aug. 18, 2008 (JP) ..... 2008-209615

(51) Int. Cl.
*H01C 1/142* (2006.01)

(52) U.S. Cl. ..... 338/327; 338/195

(58) Field of Classification Search ..... 338/327–329, 338/195
See application file for complete search history.

(56) References Cited

U.S. PATENT DOCUMENTS 4,788,524 A * 11/1988 Ozaki ..... 338/309
6,292,091 B1 * 9/2001 Kambara et al. ..... 338/195
6,636,143 B1 * 10/2003 Hashimoto et al. ..... 338/309
7,042,330 B2 * 5/2006 Nakamura et al. ..... 338/309

FOREIGN PATENT DOCUMENTS

JP 2007-49207 2/2007

* cited by examiner

*Primary Examiner* — Kyung Lee
(74) *Attorney, Agent, or Firm* — Hamre, Schumann, Mueller & Larson, P.C.

(57) ABSTRACT

A chip resistor includes a resistor element, a reinforcing member, and a pair of electrodes. The resistor element includes a first surface and a second surface opposite to the first surface. The reinforcing member is bonded to the first surface of the resistor element. The pair of electrodes are formed on the second surface of the resistor element. The resistor element is formed with a slit located between the pair of electrodes.

6 Claims, 5 Drawing Sheets

CHIP RESISTOR AND METHOD FOR MANUFACTURING THE SAME

BACKGROUND OF THE INVENTION

1. Field of the Invention

The present invention relates to a chip resistor and to a method for manufacturing a chip resistor.

2. Description of the Related Art

A conventional chip resistor is described in JP-A-2007-49207, for example. The chip resistor disclosed in this document includes a resistor element and a pair of electrodes provided on a surface of the resistor element. The paired electrodes are insulated from each other and directly bonded to the surface of the resistor element. An overcoat layer for protecting the resistor element is formed on the surface of the resistor element which is opposite from the surface formed with the electrodes. By making a resistor element using a metal plate of an alloy having a low temperature coefficient of resistance (TCR), a chip resistor having an extremely low resistance of a few milliohms (mΩ) in addition to a low TCR is obtained. To achieve a higher resistance of e.g. several tens to hundreds of milliohms, the width of the resistor element is reduced partially or part of the resistor element is removed by laser trimming or etching.

In the conventional chip resistor, however, the resistor element itself is made of a relatively thin metal plate, and the overcoat layer does not have a sufficient thickness to support the resistor element and the electrodes. Thus, when the resistor element is made narrow or partially removed, the sufficient strength to support the electrodes is not provided by the metal plate and the overcoat layer. Further, when current is applied, the resistor element is heated. In the conventional structure, the heat is trapped in e.g. the narrow portion and cannot be dissipated efficiently.

SUMMARY OF THE INVENTION

The present invention has been proposed under the circumstances described above. It is therefore an object of the present invention to provide a chip resistor which has a sufficient strength and is capable of efficiently dissipating heat.

According to a first aspect of the present invention, there is provided a chip resistor comprising: a resistor element including a first surface and a second surface opposite to the first surface; a reinforcing member bonded to the first surface of the resistor element; and a pair of electrodes formed on the second surface of the resistor element, where the resistor element is formed with a slit located between the pair of electrodes.

Preferably, the chip resistor of the first aspect may further comprise an insulating bonding layer provided between the resistor element and the reinforcing member.

According to a second aspect of the present invention, there is provided a chip resistor comprising: a plurality of resistor elements each including a first surface and a second surface opposite to the first surface; and a reinforcing member bonded to the first surfaces of the plurality of resistor elements. The second surface of each of the plurality of resistor elements is formed with a pair of electrodes. The plurality of resistor elements are spaced from each other in a direction perpendicular to a facing direction of the pair of electrodes. Each of the plurality of resistor elements is formed with a slit located between the pair of electrodes.

Preferably, the chip resistor of the second aspect may further comprise an insulating bonding layer provided between the reinforcing member and the plurality of resistor elements.

According to a third aspect of the present invention, there is provided a method for manufacturing a chip resistor. In accordance with the method, first, an assembly is prepared, which is made up of at least one metal plate and a substrate bonded to each other, where the metal plate is provided for a resistor element, and the substrate is provided for a reinforcing member. The metal plate is etched, and a protective film is formed to partially cover the metal plate. A plurality of electrodes are formed by plating on exposed portions of the metal plate, in other words, portions that are not covered by the protective film. Then, the assembly, together with the protective film, is divided into a rectangular chip (or chips each) including at least one pair of electrodes stemming from the plurality of electrodes.

Preferably, the etching of the metal plate may include forming a slit in the metal plate between the pair of electrodes.

Other features and advantages of the present invention will become more apparent from the detailed description given below with reference to the accompanying drawings.

DETAILED DESCRIPTION OF THE PREFERRED EMBODIMENTS

Preferred embodiments of the present invention will be described below with reference to the accompanying drawings.

Figure 1:
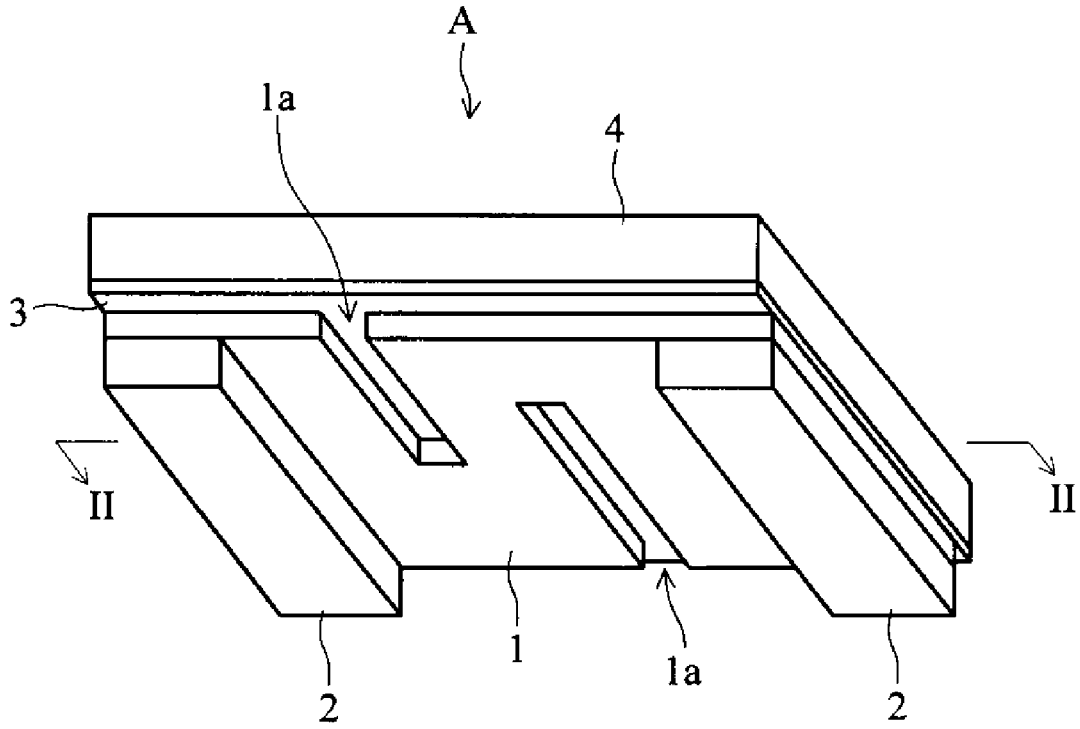
FIG. 1 is a perspective view showing a chip resistor according to a first embodiment of the present invention.
Figure 2:
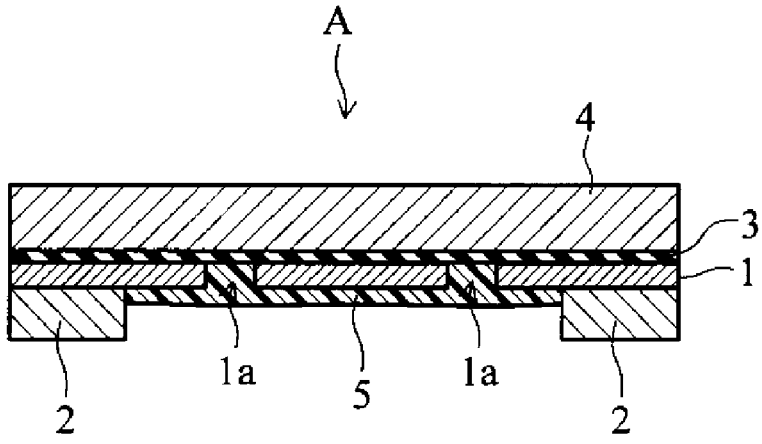
FIG. 2 is a sectional view taken along lines II-II in FIG. 1.
Figure 4A:
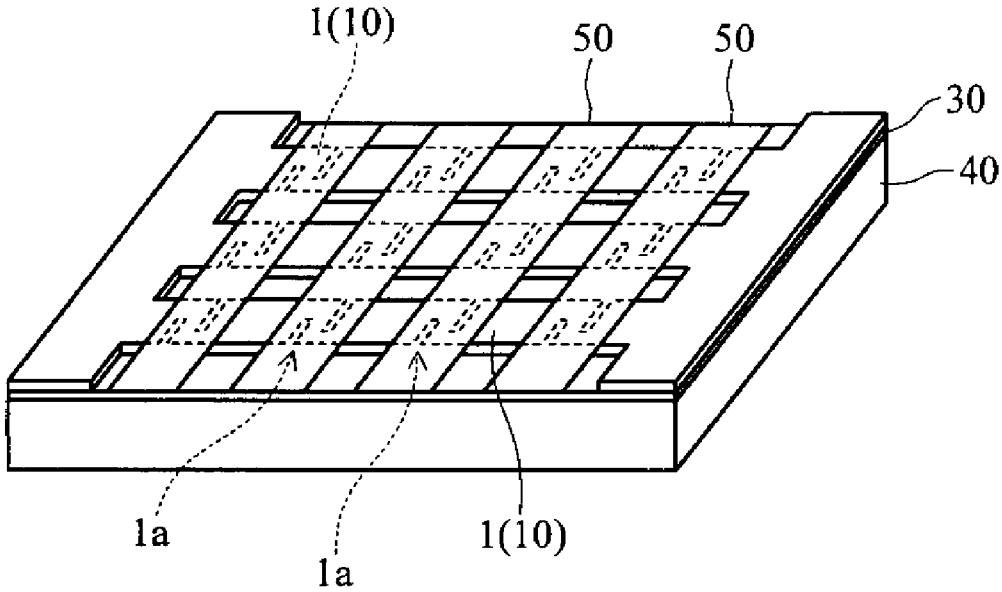
FIG. 4A shows another step of the method.
Figure 4B:
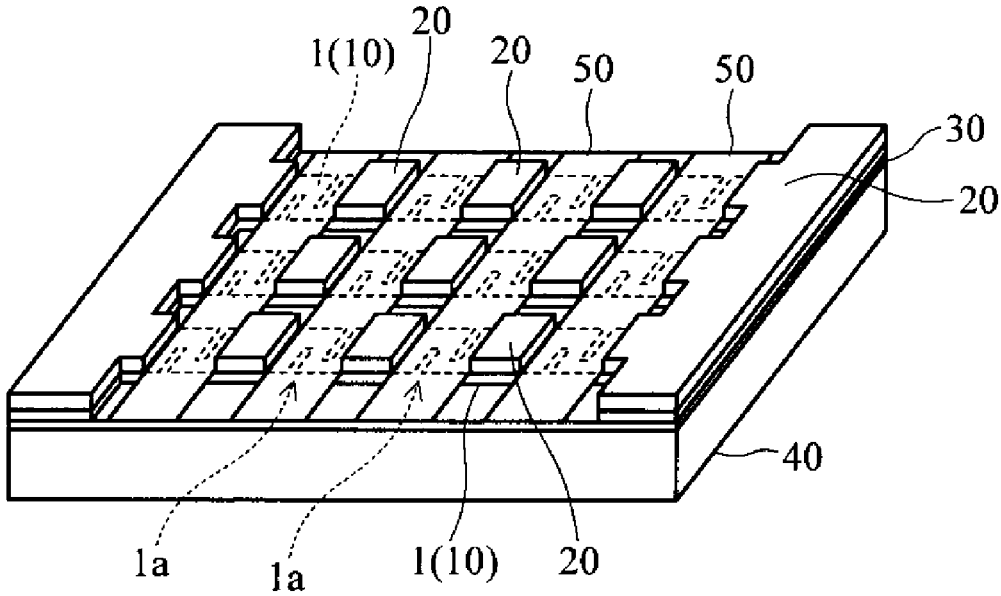
FIG. 4B shows another step of the method.
Figure 5:
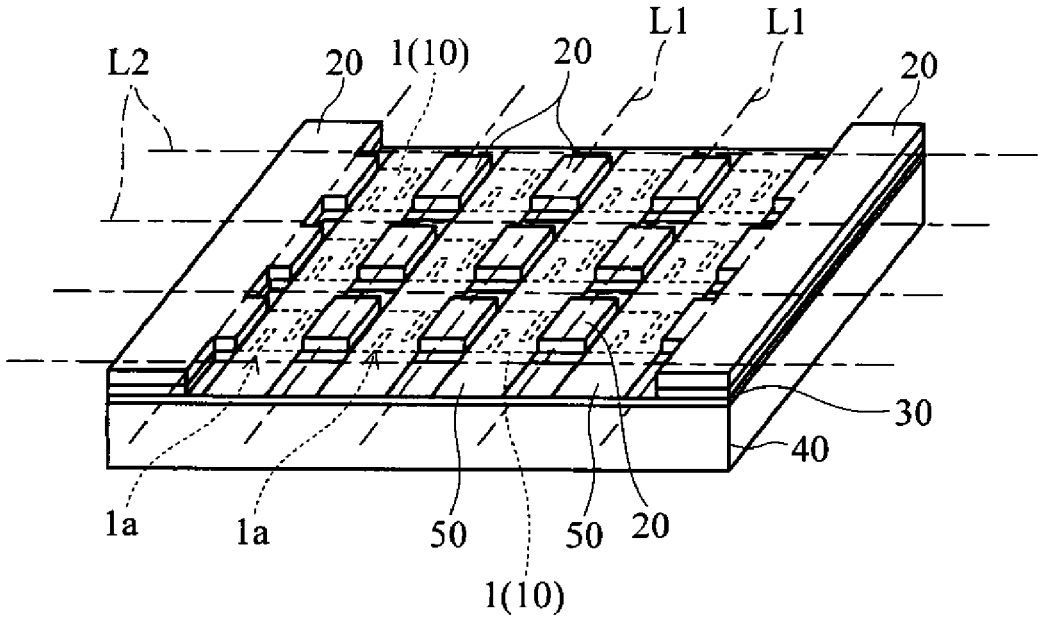
FIG. 5 shows another step of the method.

FIGS. 1 and 2 show a chip resistor according to a first embodiment of the present invention, and FIGS. 3-5 illustrate an example of method for manufacturing the chip resistor.

As seen from FIGS. 1 and 2, the chip resistor A of the first embodiment includes a resistor element 1, a pair of electrodes 2, a bonding layer 3, a reinforcing member 4 and an electrode insulator 5 (not shown in FIG. 1). The chip resistor A is a surface-mounting type having a relatively low resistance ranging from several tens mΩ to several hundreds mΩ, for example.

The resistor element 1 comprises a metal plate having a relatively low temperature coefficient of resistance (TCR). Such a metal plate may be made of an Ni—Cr-based alloy, an NI—Cu-based alloy, an Fe—Cr-based alloy or a Cu—Mn-based alloy, for example. The resistor element 1 has a thickness of about 10 to 100 μm. The resistor element 1 is formed with slits 1*a* for adjusting the resistance, but continuously extends from one electrode 2 to the other.

The paired electrodes 2 are directly bonded to a surface of the resistor element 1 (the lower surface, in the illustrated example) and spaced from each other by the interposed electrode insulator 5 (see FIG. 2). A solder layer for improving soldering reliability may be formed on the lower surface of each electrode 2. The electrodes 2 may have a thickness of about 50 to 200 μm and can be formed by plating with the use of Cu, as will be described below.

The bonding layer 3 is interposed between the resistor element 1 and the reinforcing member 4 for fixing the resistor element 1 and the reinforcing member 4 to each other. The bonding layer 3 is made of an insulating material. Thus, when the reinforcing member 4 is made of an electroconductive material, the bonding layer 3 serves as insulator for preventing the reinforcing member 4 from being connected to the resistor element 1. The bonding layer 3 has a thickness of about 60 to 100 μm, for example. As will be described below, the bonding layer 3 is made of a prepreg (insulating bonding film) which may be glass fiber impregnated with a bonding resin.

The reinforcing member 4 is attached, by the bonding layer 3, to the upper surface of the resistor element 1, which is the opposite surface to the electrode-formed lower surface. The reinforcing member 4 may be made of alumina, glass-fiber-reinforced epoxy resin or a metal (Cu, for example). The reinforcing member 4 mechanically supports the resistor element 1 (which is not stiff by itself due to its thinness), while also serving as radiator for dissipating the heat generated by the resistor element 1 upon current application. To fulfill the above functions, the reinforcing member 4 may have a thickness of about 200 to 400 μm, for example.

The electrode insulator 5 is arranged between the electrodes 2 to insulate them from each other. The electrode insulator 5 may be formed by applying e.g. an epoxy-resin-based electrically insulating material to the region between the electrodes 2.

Referring to FIGS. 3-5, a method for manufacturing the chip resistor A will be described below.

Figure 3A:
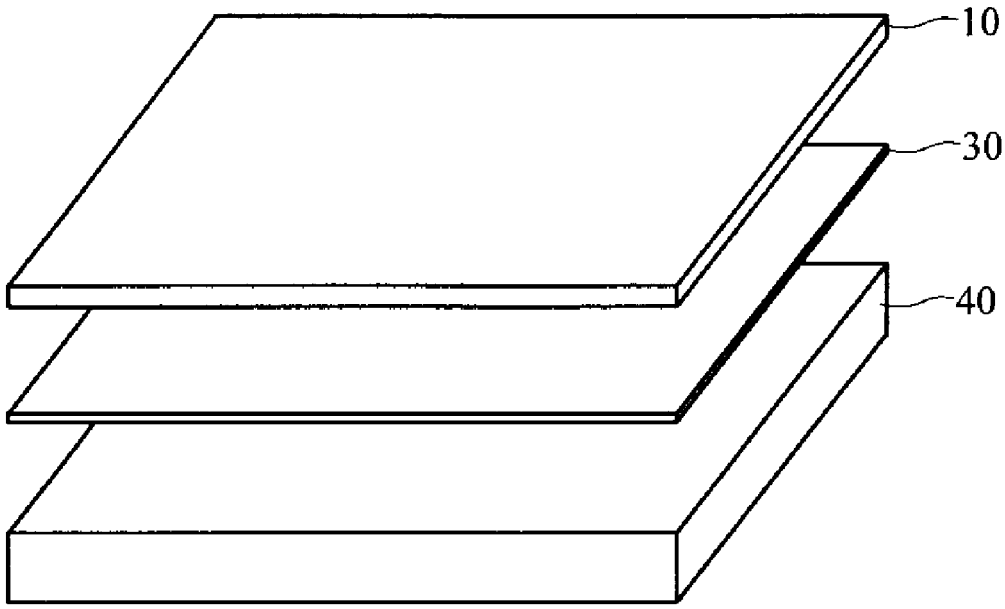
FIG. 3A shows a step of a method for manufacturing the chip resistor shown in FIG. 1.

First, as shown in FIG. 3A, a prepreg 30 (which is for the bonding layer 3) is placed between a metal plate 10 (for the resistor element 1) and a substrate 40 (for the reinforcing member 4). Then, the metal plate 10, the substrate 40 and the prepreg 30 are bonded together by vacuum press. The metal plate 10, the substrate 40 and the prepreg 30 are large enough to produce a desired number of chip resistors A collectively. The metal plate 10, the substrate 40 and the prepreg 30 have thicknesses corresponding to those of the resistor element 1, the reinforcing member 4 and the bonding layer 3, respectively.

Figure 3B:
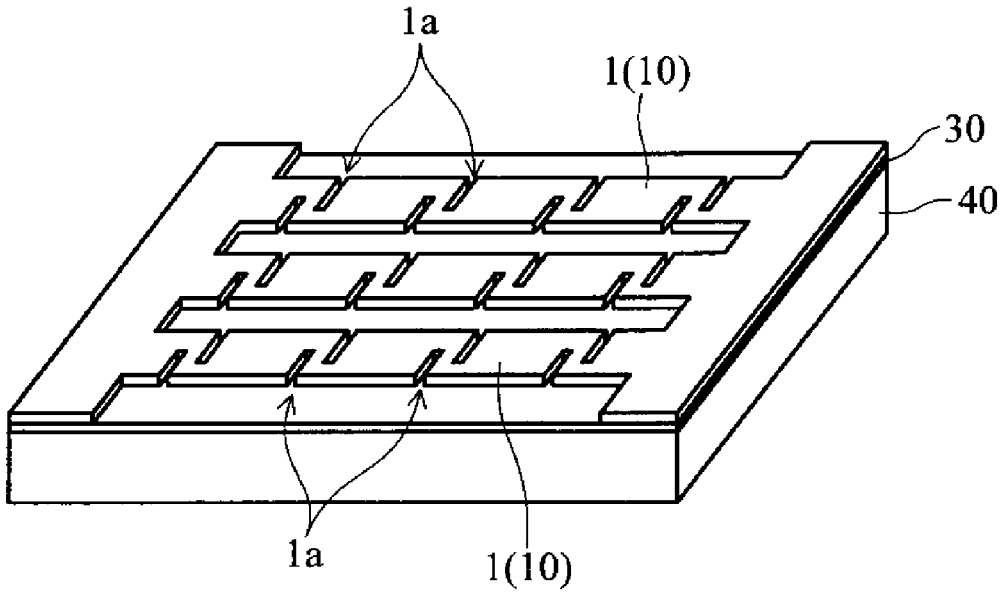
FIG. 3B shows another step of the method.

Then, etching is performed with respect to the metal plate 10 to produce a desired pattern as shown in FIG. 3B. As seen from FIG. 3B, the pattern includes a plurality of resistor elements 1 mutually connected at this stage. In this etching step, slits 1*a* are formed at predetermined portions of the respective resistor elements 1. With such slits, each of the resistor elements 1 is still continuous as one piece extending as a whole in the lateral direction (the right-left direction in the illustrated example).

Then, as shown in FIG. 4A, a plurality of protective films or strips 50 are formed to cover the slits 1*a* of the resistor elements 1. Each of the protective films 50 corresponds to the electrode insulator 5 described above. In this film making step, the resistor elements 1 are left exposed on the two sides of each protective film 50, on which the electrodes 2 are to be formed later.

Then, as shown in FIG. 4B, the unit made up of the resistor elements 1, the prepreg 30, the substrate 40 and the protective films 50 is plated with copper by rack plating. Thus, electrode layers 20, which are to become the electrodes 2, are formed on the exposed portions of the resistor elements 1 on the two sides of each protective film 50. To improve soldering reliability, a solder layer of e.g. Sn may be formed on the electrode layers 20 by plating.

Finally, as shown in FIG. 5, the unit made up of the resistor elements 1, the prepreg 30, the substrate 40, the protective films 50 and the electrode layers 20 is divided into a plurality of chips by cutting the unit along vertical cutting lines L1 extending along the electrode layers 2 and horizontal cutting lines L2 extending between adjacent two electrode layers 20. As a result, a plurality of chip resistors A as shown in FIGS. 1 and 2 are obtained.

In the chip resistor A described above, the resistor element 1 and the electrodes 2 are supported by the reinforcing member 4. Thus, even when the resistor element 1 does not have a sufficient mechanical strength due to the provision of the slits 1*a*, the chip resistor A as a whole is appropriately rigid. Further, the provision of the reinforcing member 4, which is larger than the resistor element 1 in volume, ensures efficient heat dissipation from the chip resistor A.

Figure 6:
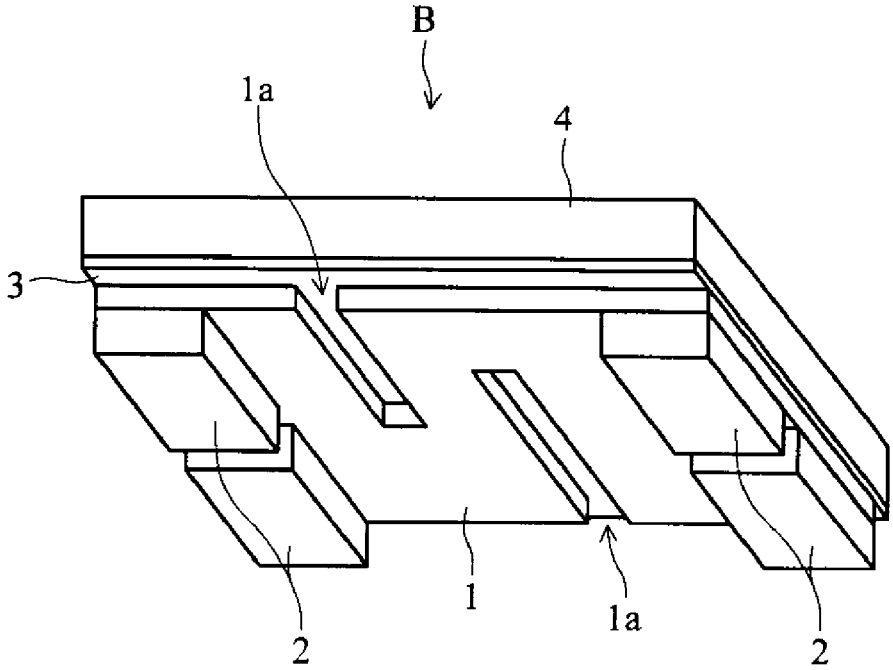
FIG. 6 is a perspective view showing a chip resistor according to a second embodiment of the present invention.

FIG. 6 shows a chip resistor according to a second embodiment of the present invention. The illustrated chip resistor B includes a total of four electrodes 2 (two electrodes 2 at the respective ends of the resistor element 1). With this arrangement, the chip resistor B is provided with a relatively large contact area for soldering, so that it can be fixed to e.g. a printed circuit board more reliably.

Figure 7:
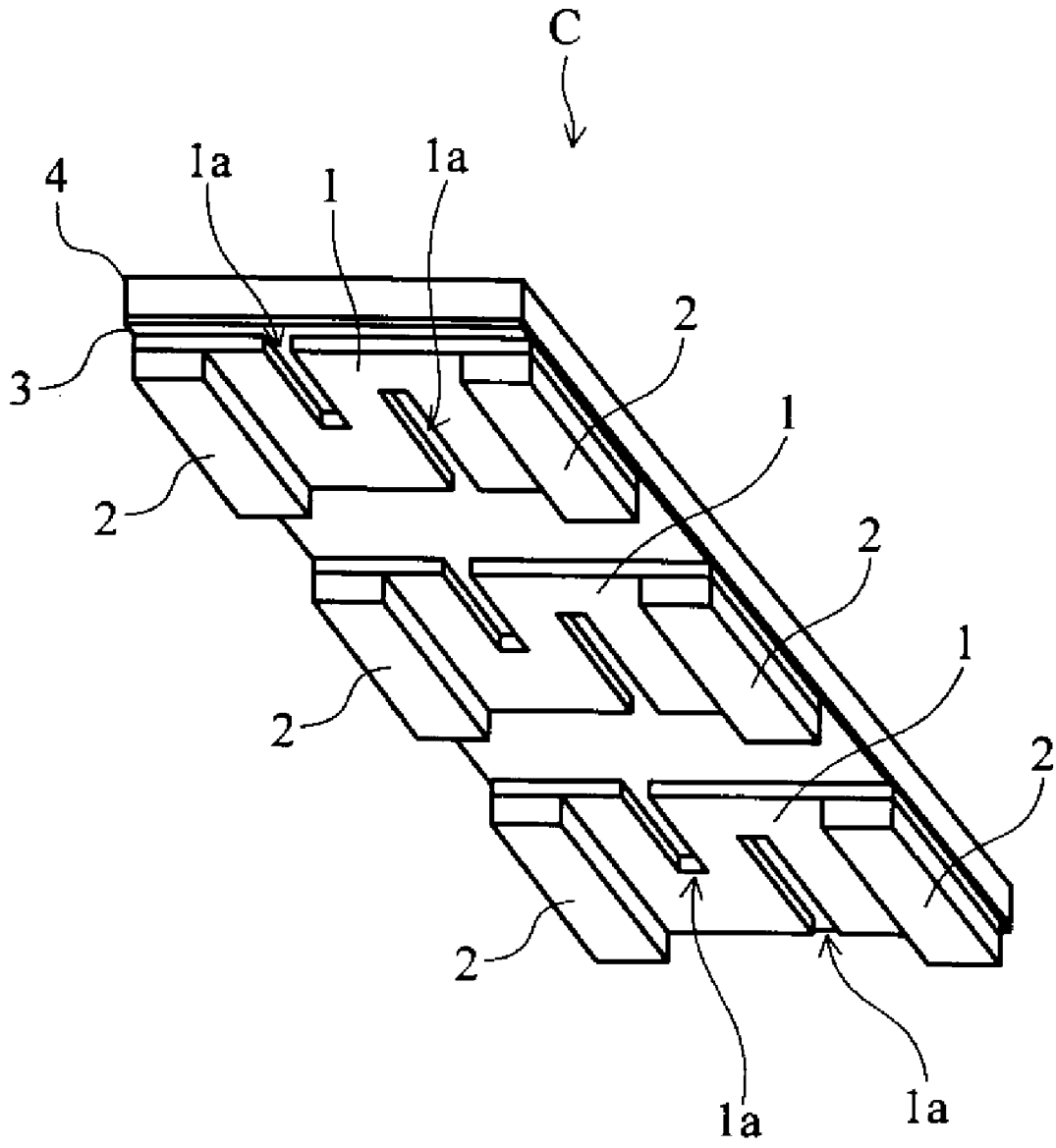
FIG. 7 is a perspective view showing a chip resistor according to a third embodiment of the present invention.

FIG. 7 shows a chip resistor according to a third embodiment of the present invention. The illustrated chip resistor C as a whole is in the form of an elongated rectangle and includes a plurality of resistor elements 1 spaced from each other in the longitudinal direction (perpendicular to the direction in which a pair of electrodes 2 on the same resistor element 1 face each other. The arrangements of each resistor element 1 and the relevant pair of electrodes 2 in the third embodiment may be the same or similar to those of the counterparts of the first embodiment shown in FIGS. 1 and 2. In the illustrated example, the chip resistor C has three resistor elements 1. It should be noted that the present invention is not limited to this example, and a chip resistor may be configured to have two or more than three resistor elements.

As illustrated in FIG. 7, the entire upper surfaces of the respective resistor elements 1 are bonded, via the bonding layer 3, to the common reinforcing member 4. To fix the chip resistor C to e.g. a wiring board by soldering, the electrodes 2 on the respective two sides of the chip resistor C are bonded to corresponding one of two electrode pads formed on the wiring board, so that the three resistor elements 1 are connected in parallel with each other.

The method for manufacturing the chip resistor C is substantially the same as the method shown in FIGS. 3-5 except for some modification made in the cutting step of FIG. 5. Specifically, in the cutting step for the third embodiment, while cuttings along the vertical cutting lines L1 are performed in the same manner as for the chip resistor A, the latter cuttings (i.e. the ones along horizontal cutting lines L2) are not performed for all the cutting lines L2 depicted in FIG. 5, but only for some of them. The illustrated example (FIG. 5) depicts four cutting lines L2 (the first or nearest cutting line L2, the second, the third, and the fourth or furthermost cutting line L2). Among these cutting lines, it is only two lines (the first and the fourth cutting lines L2, which are not adjacent to each other) along which cutting are performed.

In the chip resistor C of the third embodiment, which is in the form of an elongated rectangle as a whole, the larger reinforcing member 4 provides higher mechanical strength. Also, since no cuttings along the second and the third cutting lines L2 need to be performed, it is possible to make an efficient mass-production of chip resistors C.

The invention claimed is:

1. A chip resistor comprising:

a resistor element including a first surface and a second surface opposite to the first surface;

a reinforcing member bonded to the first surface of the resistor element;

a pair of electrodes formed on the second surface of the resistor element; and an insulating bonding layer sandwiched between the first surface of the resistor element and the reinforcing member;

wherein the resistor element is formed with a slit located between the pair of electrodes.

2. A chip resistor comprising:

a plurality of resistor elements each including a first surface and a second surface opposite to the first surface;

a common reinforcing member bonded to the first surfaces of the plurality of resistor elements; and a common insulating bonding layer sandwiched between the first surface of each of the plurality of resistor elements and the common reinforcing member;

wherein the second surface of each of the plurality of resistor elements is formed with a pair of electrodes, the plurality of resistor elements are spaced from each other in a direction perpendicular to a facing direction of the pair of electrodes, and each of the plurality of resistor elements is formed with a slit located between the pair of electrodes.

3. A method for manufacturing a chip resistor, the method comprising:

preparing an assembly comprising a metal plate and a substrate bonded to each other via an insulating bonding layer, the insulating bonding layer being sandwiched between mutually facing surfaces of the metal plate and the substrate, the metal plate being provided for a resistor element, and the substrate being provided for a reinforcing member;

etching the metal plate;

forming a protective film partially covering the metal plate;

forming a plurality of electrodes by plating on exposed portions of the metal plate that are not covered by the protective film; and dividing the assembly together with the protective film for obtaining a rectangular chip including at least one pair of electrodes stemming from the plurality of electrodes.

4. The method according to claim 3, wherein the etching of the metal plate includes forming a slit in the metal plate between the pair of electrodes.

5. The chip resistor according to claim 1, further comprising an electrode insulator provided between the pair of electrode and covering the resistor element, the electrode insulator being held in direct contact with the insulating bonding layer at the slit.

6. The chip resistor according to claim 2, wherein the reinforcing member is made of a material selected from the group consisting of alumina, glass-fiber-reinforced epoxy resin and a metal.

* * * * *